US007086100B1

(12) United States Patent
Lo

(10) Patent No.: US 7,086,100 B1
(45) Date of Patent: Aug. 8, 2006

(54) JOINING ASSEMBLY FOR CHILD'S BED

(76) Inventor: Feng-Jung Lo, No. 21, Lung Tan St., Yung Kang City, Tainan Hsien (TW)

( * ) Notice: Subject to any disclaimer, the term of this patent is extended or adjusted under 35 U.S.C. 154(b) by 0 days.

(21) Appl. No.: 11/126,204

(22) Filed: May 11, 2005

(51) Int. Cl.
*A47C 17/64* (2006.01)

(52) U.S. Cl. ..... 5/110; 5/114; 5/8; 5/187

(58) Field of Classification Search ..... 5/110, 5/111, 114, 187, 201; 108/53.1
See application file for complete search history.

(56) References Cited

U.S. PATENT DOCUMENTS 2,871,489 A * 2/1959 Emmert ..... 5/114
5,003,649 A * 4/1991 Kelly ..... 5/8
6,513,178 B1 * 2/2003 Kelly et al. ..... 5/110
6,564,400 B1 * 5/2003 Kelly et al. ..... 5/8
6,701,548 B1 * 3/2004 Vigneron ..... 5/110

* cited by examiner

*Primary Examiner*—Michael Trettel
(74) *Attorney, Agent, or Firm*—Leong C. Lei

(57) ABSTRACT

A joining assembly for a child's bed is provided. A child's bed according to the invention mainly contains a mesh structure, bedposts, and supporting rods embedded in the four rim of the rectangular mesh structure. By installing the supporting rods into the positioning holes on the bedposts, the mesh structure is expanded to a flat surface for a child to sleep or play on it. Each of the four corners of the mesh structure has a hook attached to it respectively. The hook is hooked to the rim of a positioning plate of the bedpost so that there is no gap left between the bedposts and the mesh structure.

1 Claim, 5 Drawing Sheets

JOINING ASSEMBLY FOR CHILD'S BED

BACKGROUND OF THE INVENTION

1. Technical Field of the Invention

The present invention generally relates to child's beds, and more specifically to an assembly for joining bedposts and the four corners of a bed's mesh structure so that there is no gap left there between.

2. Description of the Prior Art

There are various types of bedding furniture designed for babies and children. The Republic of China Pat. No. 517,561 discloses a type of child's bed that is structurally simple, easy to assemble/disassemble, and therefore convenient to carry and store. The teaching mainly contains bedposts, supporting rods, and a mesh structure. As illustrated in FIG. 5, the supporting rods embedded in the four rims of the mesh structure are inserted into positioning holes of the bedposts so as to expand the mesh structure into a flat surface for a child to sleep or play on it. There are also adjusting devices at the rims of the mesh structure so that the tension of the mesh structure could be adjusted.

Conventionally, child's beds similar to the one shown in FIG. 5 are usually designed for reliable assembly and usage. The safety of the child sleeping or playing on the bed is usually a secondary concern to the designer. As can be seen from FIG. 5, after the bed is assembled, there are usually gaps A left between the bedposts and the mesh structure of the bed. Even though the gaps A are not large, a child could mistakenly step into the gap very easily while standing or playing on the bed. The child would get stuck or hurt his or her ankle.

SUMMARY OF THE INVENTION

The primary purpose of the present invention is to provide a joining assembly for a child's bed to provide a higher degree of safety for the children. A child's bed according to the present invention mainly contains a mesh structure, bedposts, and supporting rods embedded in the four rim of the rectangular mesh structure. By installing the supporting rods into the positioning holes on the bedposts, the mesh structure is expanded to a flat surface for a child to sleep or play on it. Each of the four corners of the mesh structure has a hook attached to it respectively. The hook is hooked to the rim of a positioning plate of the bedpost so that the mesh structure is stretched to cover the gaps between the bedposts and the mesh structure. A child sleeping or playing on the bed therefore avoid accidentally getting stuck or hurt by stepping into the gaps left between the bedposts and the mesh structure.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
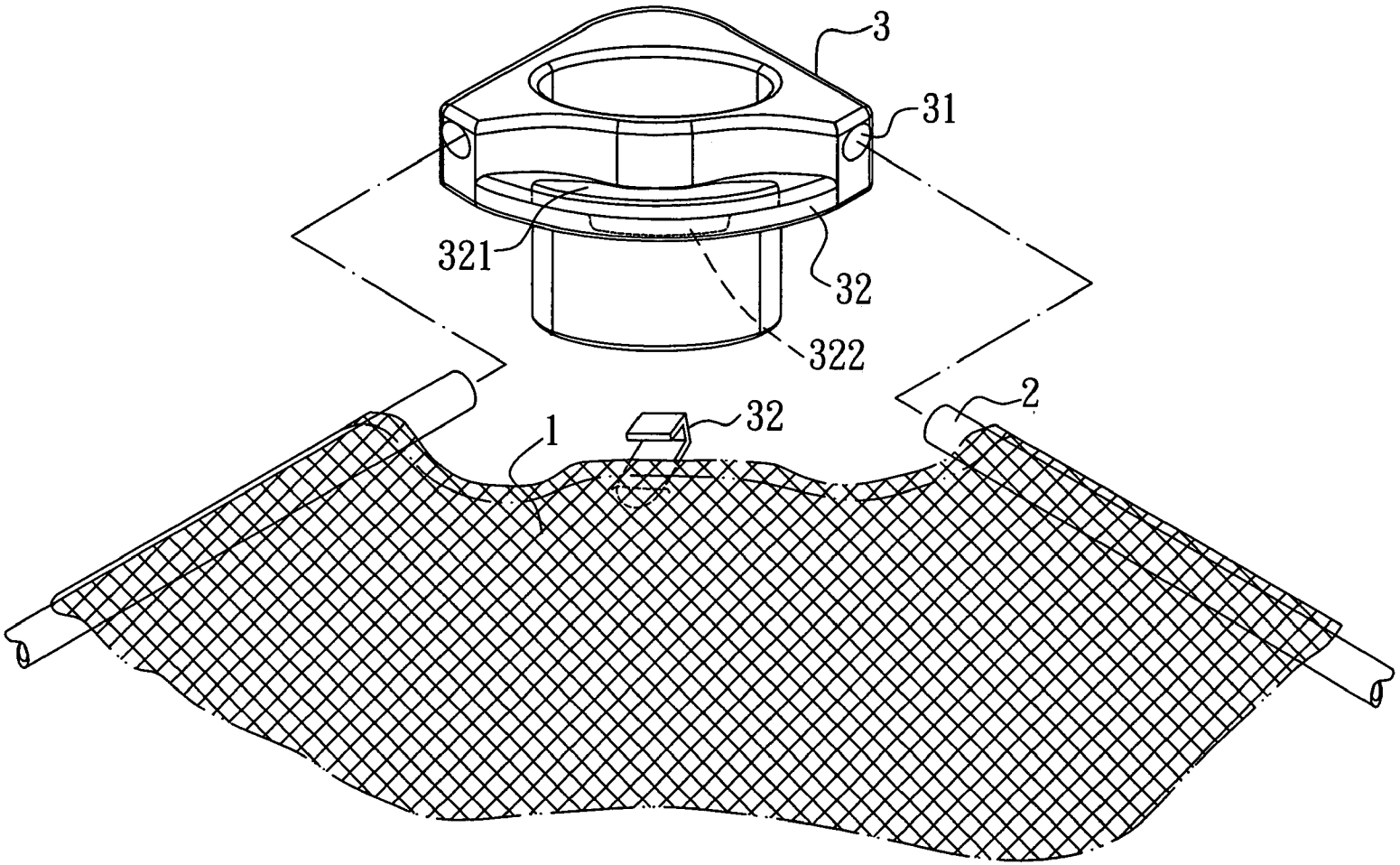
FIG. 1 is an enlarged view showing an embodiment of the joining assembly for a child's bed according to the present invention.
Figure 2:
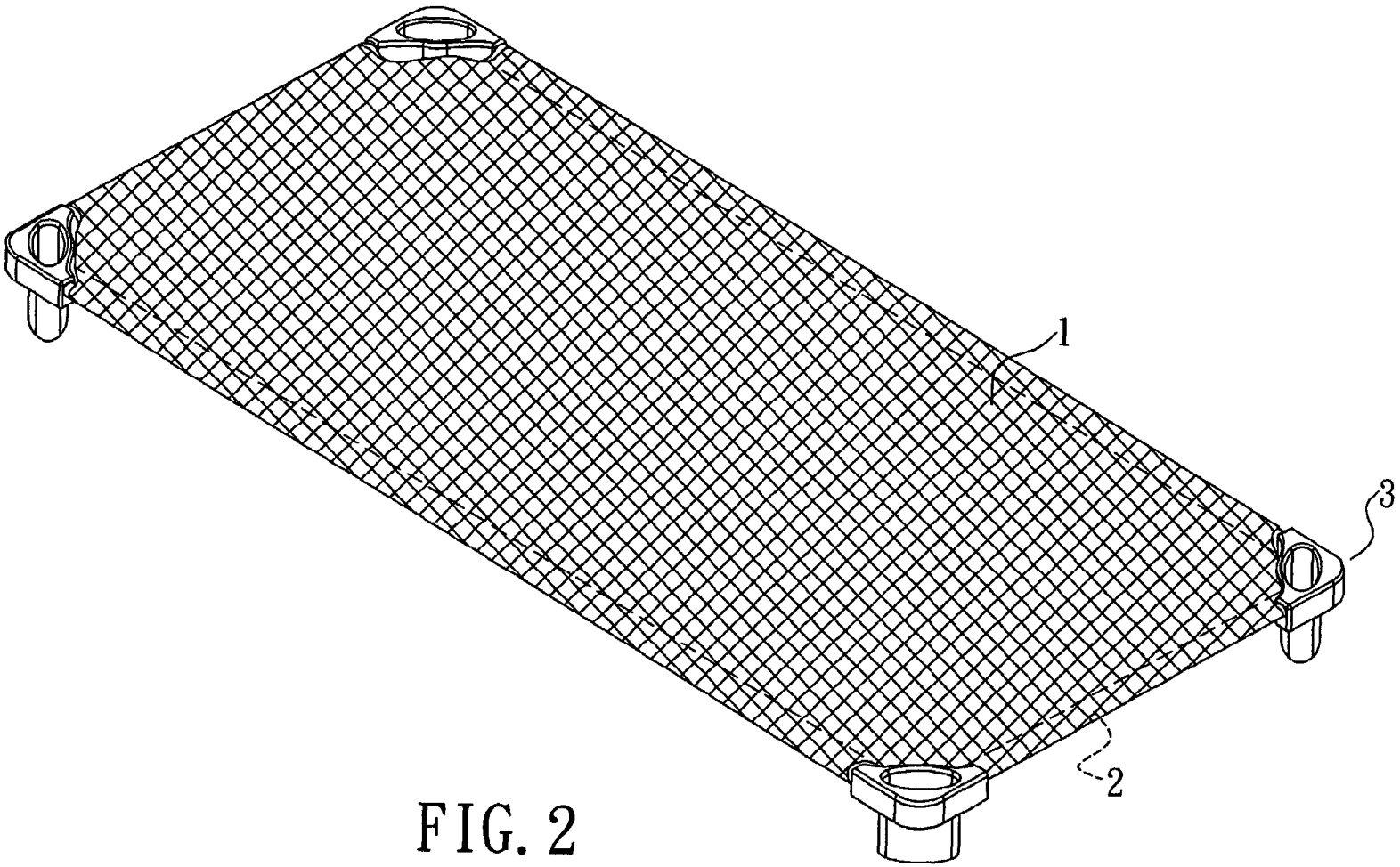
FIG. 2 is a perspective view showing the child's bed of FIG. 1.

FIG. 1 is an enlarged view showing an embodiment of the joining assembly for a child's bed according to the present invention. FIG. 2 is a perspective view showing the child's bed of FIG. 1. As illustrated, the child's bed according to an embodiment of the present invention is mainly composed of a rectangular mesh structure 1, supporting rods 2, and bedposts 3. The supporting rods 2 are embedded in the mesh structure 1 along its four rims. The ends of the supporting rods 2 are joined to the positioning holes 31 of the bedposts 3 so as to expand the mesh structure 1.

Between its two joined supporting rods 2, each of the bedposts 3 has a rim section 32 adjacent to a corner of the mesh structure 1. The rim section 32 has a vertical through opening 321 via which the corner of the mesh structure 1 could be inserted. A wall of the through opening 321 directly facing the corner of the mesh structure 1 is extended downward from the through opening 321 to form a positioning plate 322.

Each corner of the mesh structure 1 has a hook 11 attached to it. The hook 11 is configured such that the rim of the positioning plate 322 could be tucked in the hook 11.

Figure 3:
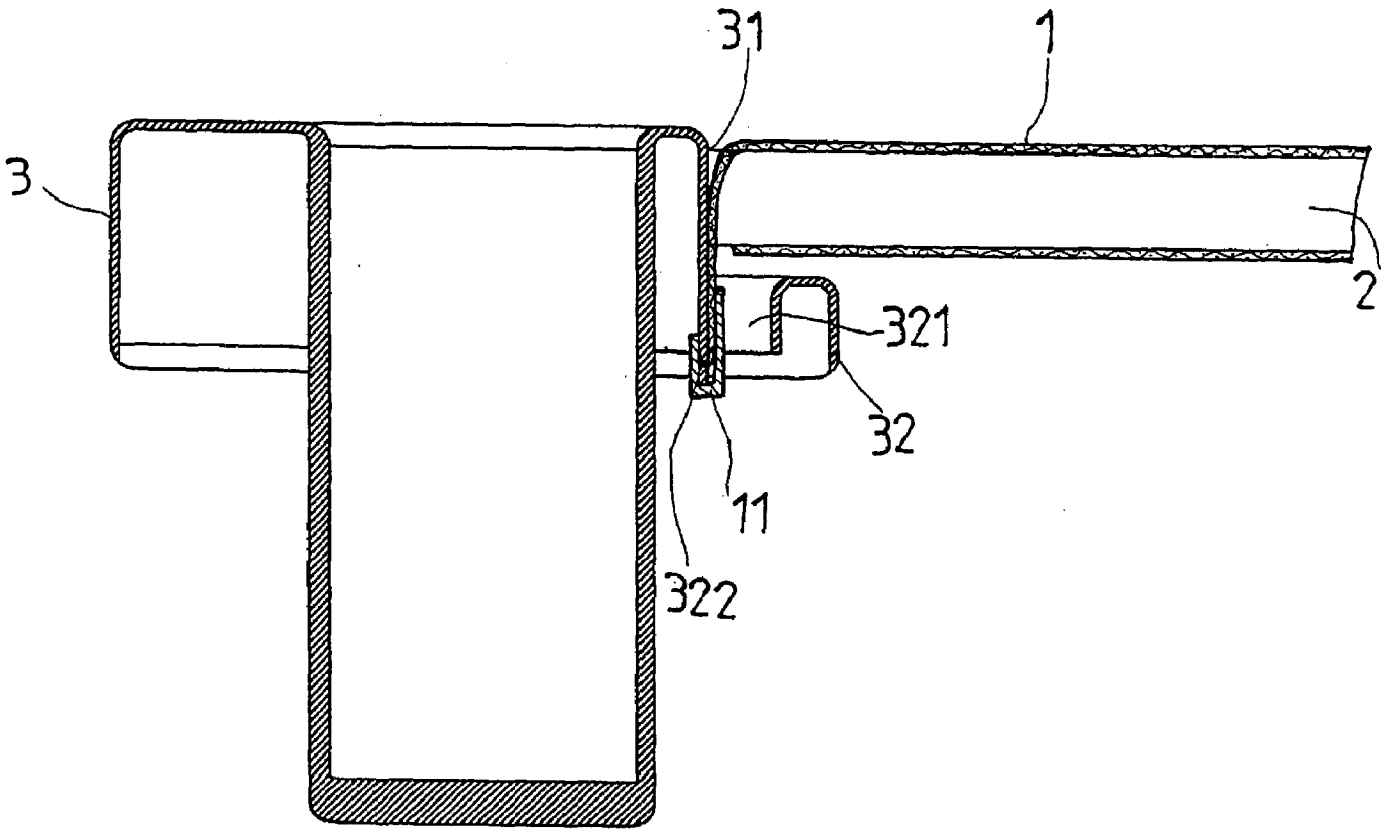
FIG. 3 is an enlarged sectional view showing the embodiment of the joining assembly of FIG. 1.
Figure 4:
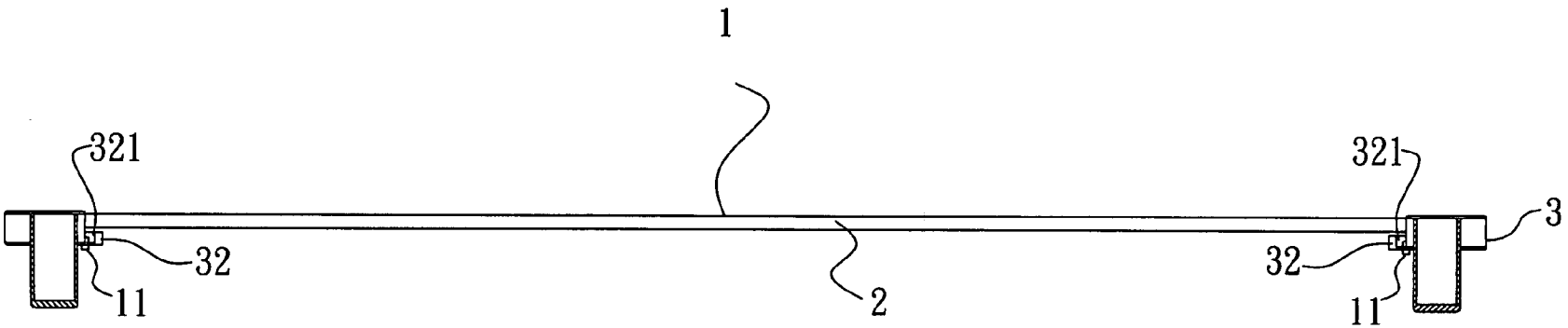
FIG. 4 is sectional view showing the child's bed of FIG. 1.
Figure 5:
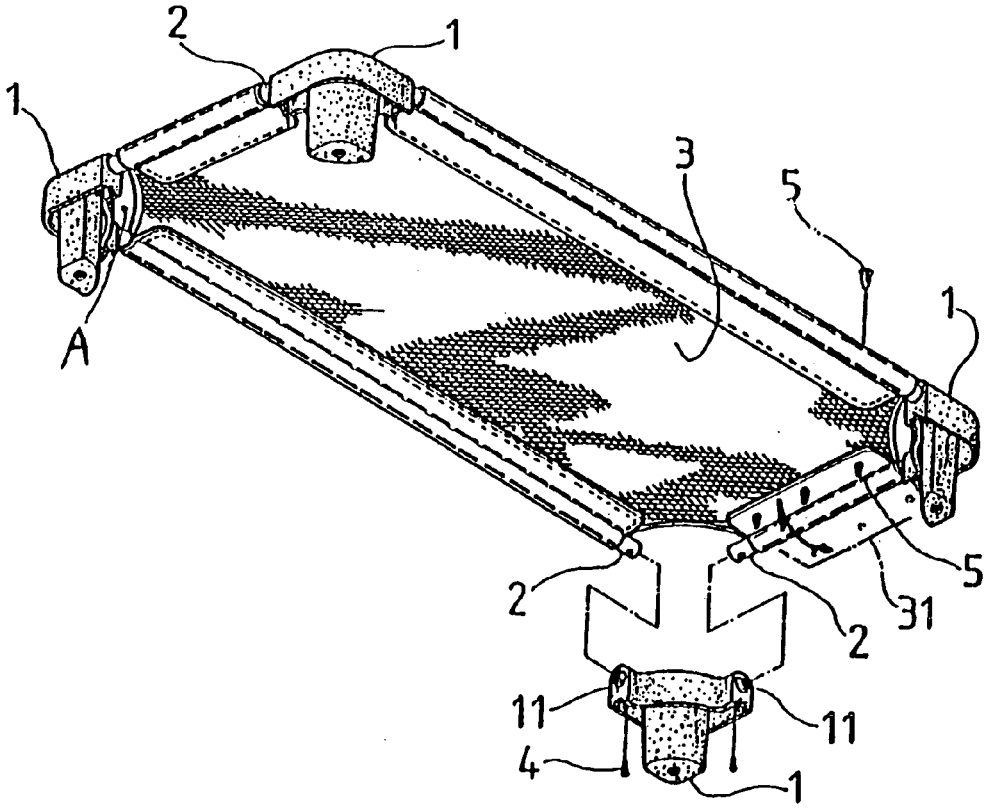
FIG. 5 is a perspective view showing a child's bed according to a prior art.

As shown in FIGS. 3 and 4, to assembly the child's bed, the mesh structure 1's four supporting rods 2 are first inserted into the positioning holes 31 of the four bedposts 3. Then, the hooks 11 at the four corners of the mesh structure 1 are slid through the through openings 321 of the bedposts 3 respectively. The hooks 11 are then hooked on the rims of the positioning plates 322 of the bedposts 3. The tension of the mesh structure 1 would keep the hooks 11 locked to the positioning plates 322.

By tightening the four corners of the mesh structure 1 through the locking mechanism provided by the hooks 11 and the positioning plates 322, there is no gap left between the bedpost 3 and the mesh structure 1. Therefore, a child sleeping or playing on the bed wouldn't mistakenly get stuck or hurt by stepping into the gaps left between the bedposts 3 and the mesh structure 1.

According to the foregoing description, it should be clear that a child's bed according to the present invention is very easy to assembly and disassemble. In addition, a child's bed according to the present invention provides a higher degree of safety for the child sleeping or playing on the bed.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A child's bed comprising:

a plurality of bedposts, each having a plurality of positioning holes, and a vertical through opening along a rim section of said bedposts, a wall of said through opening extended downward from said through opening to form a positioning plate;

a plurality of supporting rods embedded in rims of a meshy member and joined to said positioning holes of said bedposts;

a mesh structure having corners each having a hook attached to a respective one of said corners;

wherein said hooks and said corners of said meshy member pass through said through opening, and said hooks are hooked to said positioning plates so as to tighten said meshy member to leave no gaps between said bedposts and said meshy member.

* * * * *